US007591384B2

(12) United States Patent
Sheckells

(10) Patent No.: US 7,591,384 B2
(45) Date of Patent: Sep. 22, 2009

(54) SELF GRIPPING RACK WITH SNAP-ON FLEXIBLE STRAP

(76) Inventor: Amuel E. Sheckells, 2374 Old Wire Rd., Meridian, MS (US) 39301

( * ) Notice: Subject to any disclaimer, the term of this patent is extended or adjusted under 35 U.S.C. 154(b) by 1284 days.

(21) Appl. No.: 10/336,014

(22) Filed: Jan. 3, 2003

(65) Prior Publication Data

US 2003/0150826 A1 Aug. 14, 2003

Related U.S. Application Data

(60) Provisional application No. 60/344,058, filed on Jan. 3, 2002.

(51) Int. Cl.
*A47F 7/00* (2006.01)

(52) U.S. Cl. ..... 211/59.4

(58) Field of Classification Search ..... 248/49; 206/443, 446; 220/23.6; 410/32, 47, 49; 211/189, 182, 85.18, 59.4, 60.1; 108/53.1
See application file for complete search history.

(56) References Cited

U.S. PATENT DOCUMENTS

| | | | | | |
|---|---|---|---|---|---|
| 1,921,228 | A | * | 8/1933 | Hetherington | 206/585 |
| 2,662,649 | A | * | 12/1953 | Gill et al. | 206/597 |
| 2,958,492 | A | | 11/1960 | Maynard | |
| 3,019,916 | A | | 2/1962 | Malcher | |
| 3,237,786 | A | | 3/1966 | Milliken | |
| 3,283,893 | A | | 11/1966 | Durocher et al. | |
| 3,388,792 | A | | 6/1968 | Jones | |
| 3,402,904 | A | | 9/1968 | Parskewik | |
| 3,430,981 | A | | 3/1969 | Tarantola | |
| 3,627,300 | A | | 12/1971 | Caveney et al. | |
| 3,977,486 | A | | 8/1976 | Kleinschmit | |
| 4,099,617 | A | | 7/1978 | Nist, Jr. | |
| 4,175,666 | A | | 11/1979 | Smith | |
| 4,244,542 | A | | 1/1981 | Mathews | |
| 4,407,472 | A | | 10/1983 | Beck | |
| 4,618,114 | A | | 10/1986 | McFarland | |
| 4,685,846 | A | * | 8/1987 | Golay et al. | 410/49 |
| 4,744,708 | A | | 5/1988 | Cochrane | |
| 5,516,244 | A | | 5/1996 | Baka | |
| 5,556,062 | A | * | 9/1996 | Ellett et al. | 248/55 |
| 5,735,412 | A | * | 4/1998 | Sheckells | 211/59.4 |
| 6,105,907 | A | * | 8/2000 | Komsitsky | 248/71 |
| 6,224,024 | B1 | * | 5/2001 | Fritz | 248/55 |
| 6,592,084 | B1 | * | 7/2003 | Nile | 248/104 |
| 7,131,620 | B2 | * | 11/2006 | Murphy | 248/505 |

FOREIGN PATENT DOCUMENTS

| | | |
|---|---|---|
| DE | 2208139 | 8/1973 |
| GB | 532207 | 1/1941 |
| GB | 561423 | 5/1944 |
| GB | 2229169 | 9/1990 |

* cited by examiner

*Primary Examiner*—Sarah Purol
(74) *Attorney, Agent, or Firm*—Birch, Stewart, Kolasch & Birch, LLP

(57) ABSTRACT

A rack for holding articles such as propane tanks. Two holders having curved sides are attached by a flexible strap and rest on top of two of the tanks to form a seat for a third with the attached strap. The strap extends around the periphery of the holder through a series of H-shaped cutouts in order to hold the strap firmly in position by friction and to form a pad to prevent damage to the surface of the tank. Anchors may also be provided made of a tube with a central rod placed therein between which the strap is placed.

23 Claims, 6 Drawing Sheets

SELF GRIPPING RACK WITH SNAP-ON FLEXIBLE STRAP

CROSS-REFERENCE TO PROVISIONAL APPLICATION

This application claims the benefit of U.S. provisional application 60/344,058 filed on Jan. 3, 2002.

BACKGROUND OF INVENTION

1. Field of the Invention

The present invention relates generally to a self-gripping flexible rack for stacking articles such as propane tanks and more particularly to a self-gripping flexible rack having a flexible strap extending around the rack holder body.

2. Description of the Background Art

Various types of racks are known for stacking and transporting articles such as propane tanks. With their round configuration, it is difficult to transport a number of large tanks due to legal limitations on the size of the truck. In addition, the racks may be heavy and bulky, thus taking up additional space and adding an extra load to the truck, leading to increased fuel usage. It is also often necessary to use a crane or multiple people to place the rack on the truck, leading to increased costs.

U.S. Pat. No. 5,735,412 describes a rack system which is a major improvement over prior art systems. In this rack system, a pair of holders, each having curved sides to match the shape of the propane tank, are joined by a flexible strap. The strap acts as a seat for an additional tank placed between the original two tanks onto which the holders are placed. Because of the small size of the holders and strap, it is possible to carry additional tanks on the same size truck. The weight of such rack is considerably less than prior art systems, which reduces the weight on the truck and allows for easy installation by a single person. In this system, the strap is connected to the holder by sewing the end of the strap to make a loop and inserting a bolt through the holder and the loop to fasten it in position. In order to prevent any damage to the paint on the tanks, pads are placed along the contacting surfaces of the holders.

While this system was a major improvement over prior art devices, the placing of the pads requires considerable time, using skilled labor and laboratory conditions to install. When pads wear out and need to be replaced, it is necessary to sand the metal to acquire a clean surface. As a result, the metal parts must be relatively thick so that multiple sandings do not reduce the strength of the holder. The holders must then be heavier than would otherwise be necessary. The loop formed by sewing the end of the strap is weaker than the other parts of the system and accordingly limits the amount of weight the system can hold. Also, the operations of sewing a strap and inserting a bolt require a certain amount of time and cost.

SUMMARY OF THE INVENTION

Accordingly, the present invention provides a rack for stacking articles such as propane tanks on a truck or other vehicle.

The present invention also provides a rack on which articles can be shipped without damage.

The present invention further provides a lightweight rack which is easily installed manually.

The present invention also provides a rack which is easily assembled.

The present invention further provides a system which is easily assembled by unskilled labor at a low cost.

The present invention still further provides a rack system having holders made of thin metal parts to reduce the weight of the system.

The present invention still further provides an anchoring device for holding a strap on a rack.

The present invention still further provides a strapping system for holding articles such as propane tanks.

The present invention is accomplished by providing a rack having a plurality of holders for receiving round articles. A flexible strap extends between two holders made of metal. The flexible strap acts as a seat for an article placed between the holders. The flexible strap extends around the periphery of each holder through a series of cutouts for easy assembly. The strap can also be attached to a simple anchoring device including a length of tubular material having a slot formed along one side for receiving the strap and a second solid cylindrical rod within the tube around which the strap is placed.

BRIEF DESCRIPTION OF THE DRAWINGS

The present invention will become more fully understood from the detailed description given below and the accompanying drawings which are given by way of illustration only, and thus are not limitative of the present invention, and wherein.

DETAILED DESCRIPTION OF THE PREFERRED EMBODIMENTS

Figure 2:
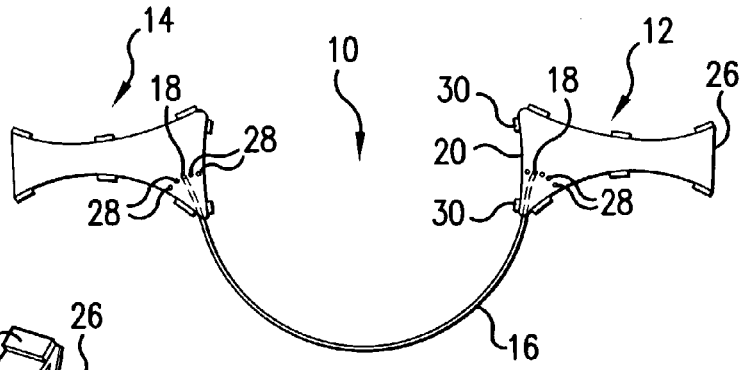
FIG.2 PRIOR ART
FIG. 2 is a side view of a rack of the prior art.
Figure 1:
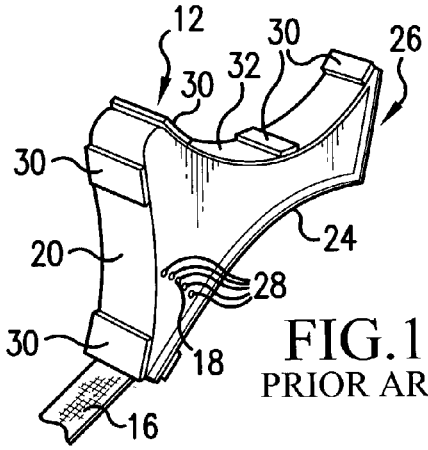
FIG.1 PRIOR ART
FIG. 1 is a perspective view of one holder of a rack of the prior art.

Referring to the drawings, wherein like reference numerals designate identical or corresponding parts throughout the several views, and more particularly to FIG. 2 thereof, wherein a rack 10 according to the prior art is shown. This rack includes two holders 12 and 14 to which a flexible strap 16 is attached. Each end of the strap is formed into a loop through which a bolt 18 is placed. A series of holes 28 are provided in each holder, so that the position of the bolt can be varied to vary the length of the strap. One of the holders 12 is shown in more detail in FIG. 1, including four sides 20, 22, 24 and 26. Along the periphery of the holder are placed pads 30 to prevent damage to the paint of the tanks or other articles which are held by the rack. FIGS. 1 and 2 correspond to FIGS. 1 and 2 of U.S. Pat. No. 5,735,412 which describes in more detail the construction of this prior art device.

Figure 3:
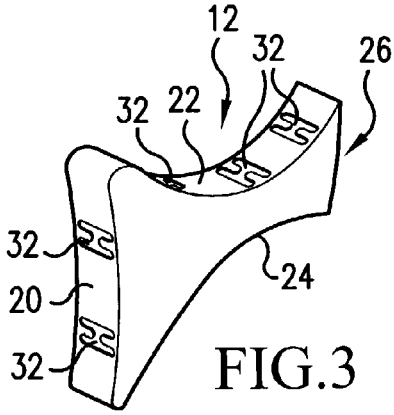
FIG. 3 is a perspective view of a holder of the rack according to the present invention.
Figure 10:
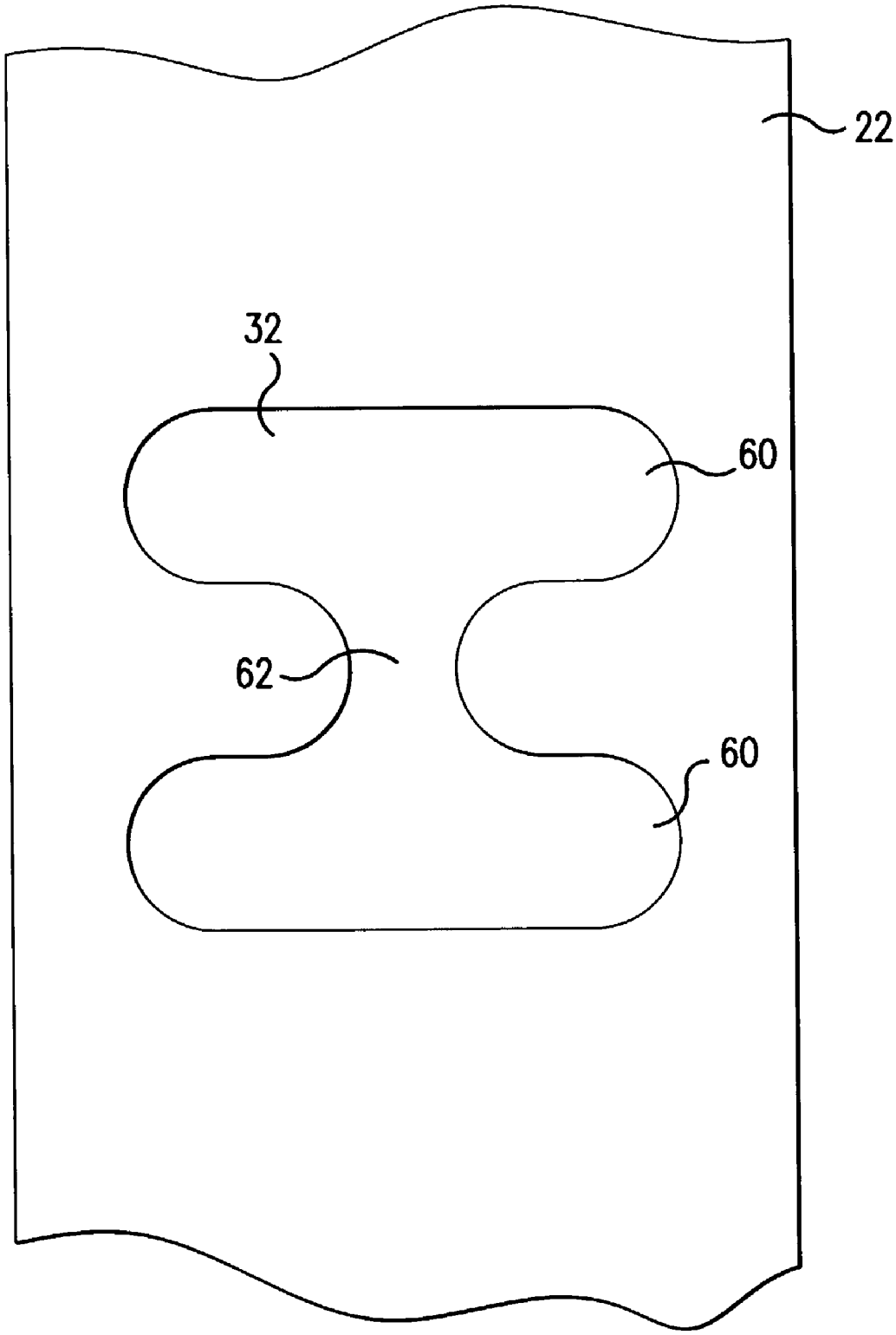
FIG. 10 is a top view of a cutout according to the present invention.

FIG. 3 shows a perspective view of a holder of the present invention. Holder 12 includes sides 20, 22, 24, 26, as in FIG. 1. However, in the present invention, the pads 30 are not used, nor is bolt 18 used to hold the end of the flexible strap. Instead, the four sides of the holder have H-shaped cutouts 32 formed therein. As shown in FIG. 10, each cutout is formed of two parallel openings 60 extending across a large portion of the width of each side and joined by a narrow opening 62 extending perpendicularly thereto. The number of cutouts on each side is variable and depends on the size of the holder (and hence the size of articles held), and the weight of the articles held. For example, four cutouts may be provided on longer sides 22 and 24, two on side 20 and one on the shortest side 26. If desired, side 26 may be extended to have the same dimension as side 20, so that the holder is symmetrical.

Each of these cutouts is used to receive the flexible strap 16. Instead of anchoring the end of the strap using a loop and bolt arrangement, the strap is wrapped around the four sides of the holder by being received within each H-shaped cutout. The strap may be snapped into place either by threading the strap into one of the two parallel openings and out the other, by folding the strap lengthwise and inserting the folded portion through the shorter connecting opening before releasing the fold or by inserting the strap edgewise into the opening, and then returning it parallel to the side. This operation is easily handled by an unskilled worker and can easily be accomplished in a short period of time. The cutouts act to hold the strap in position by providing a certain amount of friction. The total amount of friction provided by a series of cutouts along the four sides is often sufficient to hold the strap against the weight of the tank being carried. However, if necessary, the end of the strap can be anchored in a fashion to be described below to further prevent movement of the strap.

Figure 4:
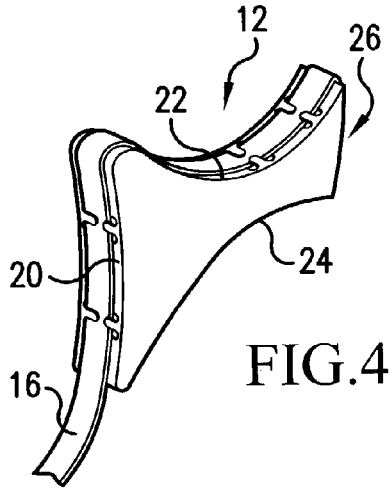
FIG. 4 is a perspective view of a holder of the rack according to the present invention with the flexible strap attached.

FIG. 4 shows a perspective view of the holder 12, as shown in FIG. 3, but with the strap in position. As can be seen, the strap extends into each cutout and then lies on top of the corresponding side holder between cutouts. Since the strap can be present on all four sides by snapping the strap into place around the entire periphery of the holder, pads 30 are no longer necessary. That is, the strap itself acts as a pad to prevent damage to the articles being held. This results in great savings in the construction of the device since the strap is easily snapped into place, as described above, compared to the required cleaning and gluing arrangements necessary to place the pads in position. Equally importantly, since the pads are not present, there is no need to sand the side pieces during a pad replacement procedure. Accordingly, the side pieces may be made of much thinner material, which makes the holder much lighter in weight. This allows a single person to easily place the rack in position without the need for a crane or other help.

Although FIG. 4 shows a single strap extending to the left from holder 12, in fact the end of the strap from both sides 20 and 24 extend to the left to form a double thickness strap holding the tank between the holders. It would be possible for one of these straps to merely be folded around the corner of the holder while the other strap continues so that it is held in place. If desired, the strap can also be locked into place using an anchor as described later.

Figure 12:
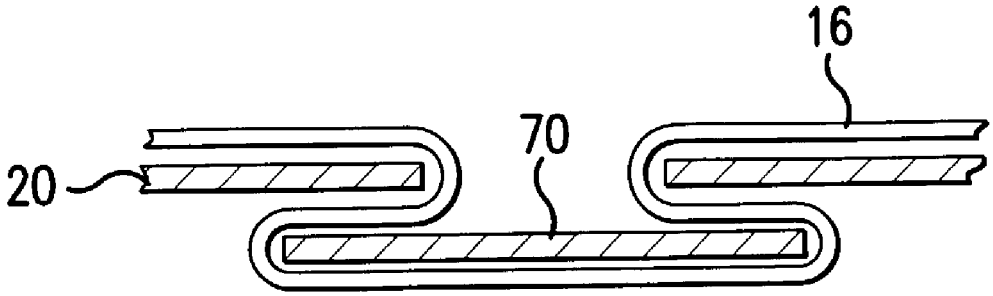
FIG. 12 is a side cross sectional view of one side of a rack according to the present invention.

In order to make minor adjustments in the length of the strap, it is also possible to insert shims between the strap and the center of the H-shaped cutout to increase the strap length by the thickness of the shim. Long shims may also be used for longer adjustments by forming a large loop on the backside of the cutout. Such an arrangement is seen in FIG. 12 where in a cross sectional view, one side of the holder, such as 20, receives strap 16 to form a loop on the backside of side 20. Shim 70 is inserted into the loop in order to tighten the strap. If desired, the shim may be used to secure the strap firmly by having a shim large enough to take up all the slack of the strap.

If desirable, it would also be possible to place extra padding between the strap and the sides of the holder. This can be in the form of a sleeve through which the strap passes. In this arrangement, the sleeve does not move in relation to the tanks, but the strap can be moved within the sleeve for tightening the strap, if necessary. This arrangement also prevents any rubbing between the strap and the tank surface to prevent any damage to the surface of the tank.

By extending the strap around the periphery of the holder, the padded area of the holder becomes much larger than by the use of pads. This provides an additional protection to the articles being held. The device also is stronger since the sewn loop is no longer present, which removes the weak point of the holder. While some additional cost is required to form the cutouts in each side, this is relatively cheaply and quickly accomplished either by cutting with a torch or using other forms of metal working such as punching or cutting. The cost for these simple operations is considerably less than the operation of sewing the end of the strap, forming a series of holes and inserting a bolt and nut therethrough. In addition, the metal of the holder may be considerably thinner, reducing the weight of the device and the cost of making it.

Although the cutout shape has been described as an H-shape, any shape which will hold the strap in position may be used as long as the strap extends around the periphery of the holder and is held firmly in position. Other possible shapes include a simple slot cutout extending across the width of a side of the holder. A loop of the strap may be inserted through the slot and a simple pin or rod placed in a loop behind the slot. If the width of the rod with a loop passed therearound exceeds the width of the slot, the strap will be held in position. That is, the tightening of the loop against the backside of the slot adds sufficient friction to prevent the movement of the strap. Another possible shape of a cutout is a simple circle. This may be used for the shim arrangement as discussed above, so that the strap is easily placed through the circular opening and the shim inserted therein so as to take up any slack in the strap and lock it in position. Any number of other shapes are also possible. Also, other arrangements for holding the strap in position may be used, which do not use cutouts, as long as the strap extends around the periphery of the holder.

Although the preferred width of the strap is about 4 inches for carrying standard propane tanks, any width can be utilized depending on the size and weight of the object carried. Also, more than one thickness of the strap may be utilized in order to provide thicker padding.

Figure 5:
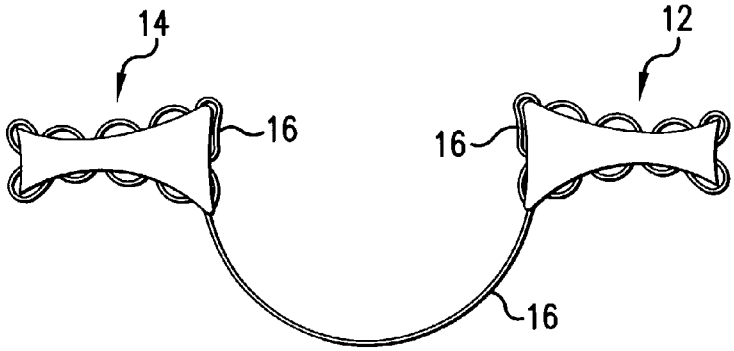
FIG. 5 is a side view of the rack of the present invention.

FIG. 5 shows a side view of the rack of the present invention, which may be compared to FIG. 2 showing the prior art device. The strap 16 forms a similar seat for a tank and holders 12 and 14 have a similar structural construction except as noted above. However, as can be seen in FIG. 5, the strap 16 continues around the periphery of each holder except where it extends into each cutout. For ease of illustration, the number of cutouts on each side has been reduced and the extension of the strap away from the side has been exaggerated.

Figure 11:
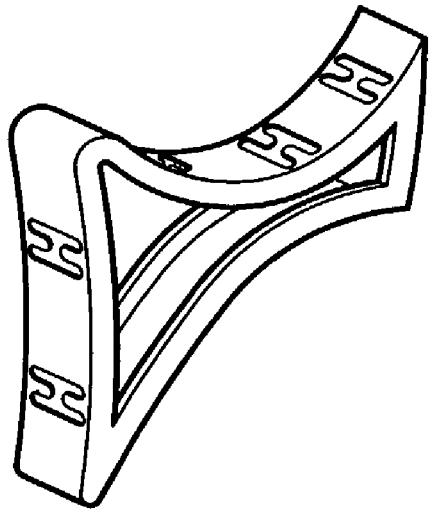
FIG. 11 is a perspective view of a holder according to the second embodiment of the present invention.

FIG. 11 shows another embodiment of the present invention. In this case, channel material is used for the four sides of the holder, rather than using flat material for the four sides and two ends. When the solid ends are utilized, the sides and ends must be welded together. By using channel material, only the ends of each side need to be welded. This cuts costs in the construction of the device. At the same time, the overall weight of the device is considerably less. Since the upstanding parts of the channel material do not extend as far as the width of the holder, openings are formed on each end of the holder. As a result, it is possible to reach inside the holder in order to more easily place shims or rods to adjust the straps. However, because of the strength of the channel design, very little strength of the holders is lost in this process.

Figure 13:
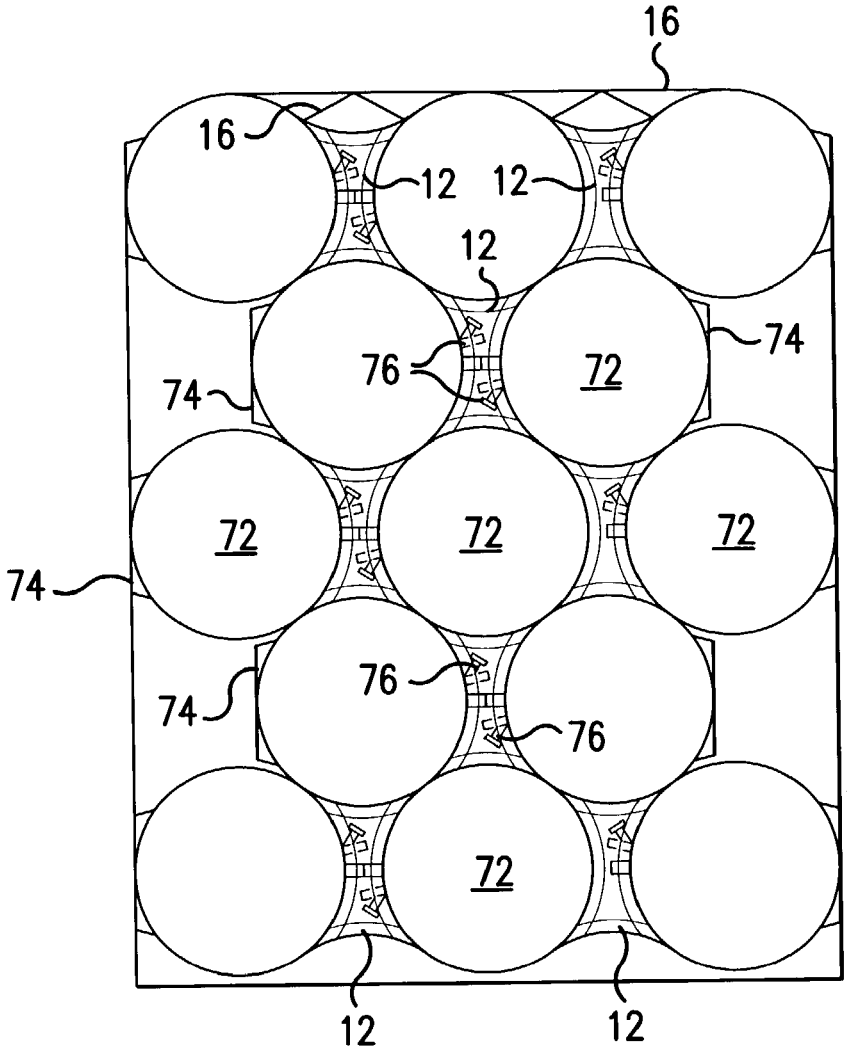
FIG. 13 is an end view of a rack system of tanks according to the present invention.

Since tanks come in many different sizes, further arrangements are sometimes necessary in order to best utilize whatever space is available on a truck. For smaller tanks, a different arrangement of the holders is desirable. As seen in FIG. 13, a large number of tanks, such as 13 may be placed on a flat bed truck using the arrangement shown. In this arrangement, the holders use a symmetric design where sides 20 and 26 are the same dimension. The holders are placed with their longest dimension in the vertical direction, or 90° to the direction shown in FIG. 2. Because of this arrangement, the strapping proceeds in a different arrangement than shown in the earlier figures. However, the same concept of extending the straps through cutouts on the sides of the holder continues. In this figure, the various holders are labeled 12. Each tank 72 carries a bottom holder or foot 74 and various controls or filler openings 76. The holders must be of large enough width that there is space between the tanks for the controls and openings. The feet shown have the bottom of the tank in contact with the center part of the feet, as a space saving measure. By using arrangements such as this, it is possible to have thirteen 30 inch tanks placed on a standard flat bed truck using a holder having a 5.725 inch width at its center.

Figure 14:
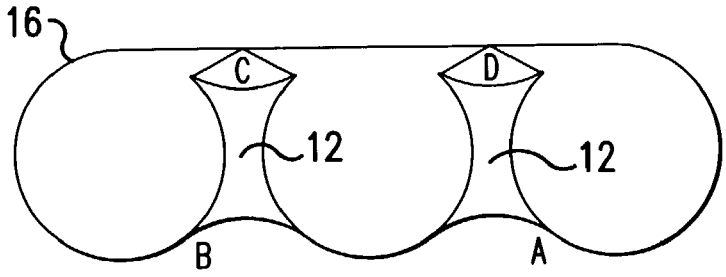
FIG. 14 is a diagram showing an arrangement of a strap used in a rack of the present invention.

In order to support the tanks which are on the outside and hence cantilevered, a different type of strapping arrangement is utilized for the holders. The arrangement of the strap is shown in FIG. 14. Two holders and a strap connect three tanks together as a unit. The strap starts at point A and extends along the bottom side of the right hand rack through two cutouts. It then proceeds under the center tank and through cutouts on the bottom edge of the left hand rack. The strap then extends under and around the left hand tank and extends over the top of the center tank and right hand tank and then down and under the right hand tank to return to point A. At this point, the strap extends up the right hand side of the right hand rack. When it reaches the top of the right hand rack, the strap is placed over itself at a point between the center and right hand tanks. By looping this over, portions of the strap that extend horizontally across the top to the right hand tank are support firmly the right hand rack. It would be also possible to sew or otherwise connect the two parts of the strap together at point D rather than looping it over the top. At this point, the strap extends down along the left hand side of the right hand rack through the appropriate cutouts and also extends under the center tank. Then it extends up the right hand side of the left hand rack and loops over the top portion of the strap at point C in a fashion similar to that at point D. The strap then extends down the left hand side of the left hand rack and ends at point B. Two ends of the strap may be anchored by sewing, by using an anchor described later or may be held by the friction developed in the cutouts. By strapping three tanks and two holders together in this fashion, it is possible for the assembly to be lifted by a forklift by extending forks under the racks, or by lifting from above by pulling up the strap along its top section, such as to the left of point C and to the right of point D. When these units are placed in a stack, the tanks above force downwardly on the upper racks and firmly hold the tanks in position.

A similar arrangement can be made for the units which have two tanks and a single rack which go between the layers of the three tank units on a truck. It would also be possible to utilize holders which extend only half way in the vertical direction. However, the straps continue upwardly to points C or D and return down to the half rack in the same fashion as the full rack. Fewer cutouts will be engaged by the strap using this arrangement. However, if sufficient anchors are provided otherwise, this is a viable option. The advantage of this is that the weight of the rack is reduced, lowering shipping costs.

Figure 15:
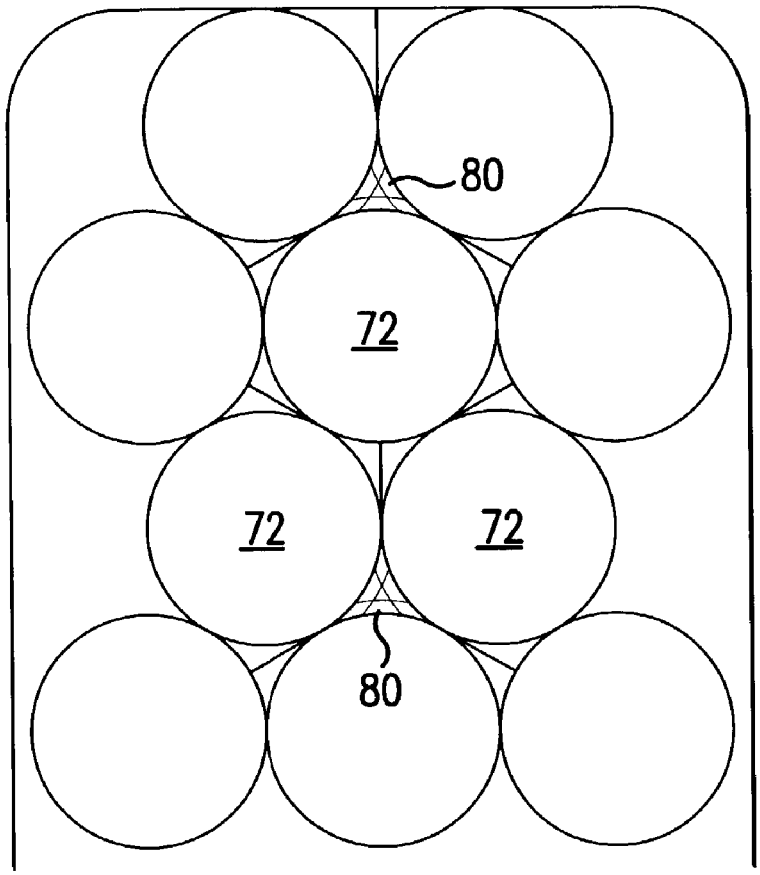
FIG. 15 is an end view of a rack system with tanks showing another arrangement according to the invention.
Figure 16:
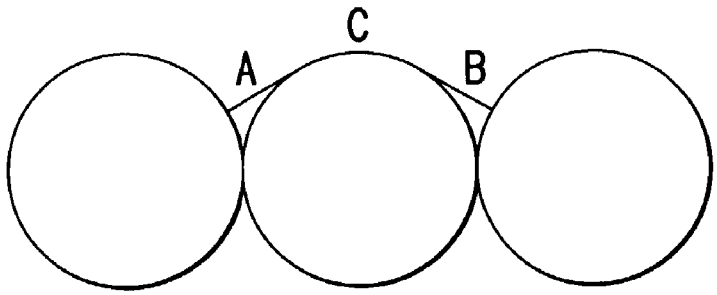
FIG. 16 is a diagram showing an arrangement of a strap used for holding tanks according to the present.

Some tanks are made without feet or controls extending outwardly radially from the tank. These type of the tanks may be stacked in a similar fashion. As seen in FIG. 15, these tanks 72 may be placed in alternating rows of three or two tanks. In this arrangement, a rack 80 may be used which is similar to the half rack described above, but where the width between tanks is reduced to zero. That is, adjoining tanks actually touch, with the rack forming a more or less triangular arrangement between adjoining tanks. With this kind of arrangement, an assembly of three tanks and two racks can be utilized if desired. However, as described above, using a half rack requires that the strap extend without a rack in the vertical direction until it reaches the horizontal portion of the strap extending over the tops, of the tanks. The arrangement of tanks shown in FIG. 15 is especially desirable for overseas shipping containers and allows additional tanks to be inserted in this space.

Figure 6:
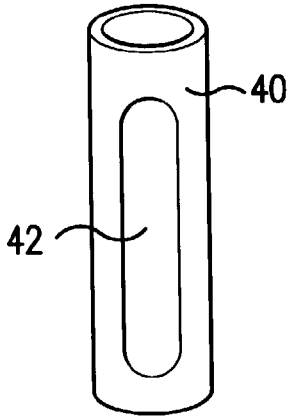
FIG. 6 is a perspective view of a tube used in an anchor of the present invention.
Figure 7:
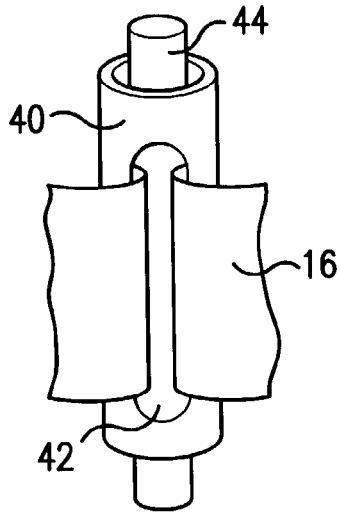
FIG. 7 is a perspective view of an anchor having a strap attached thereto according to the present invention.
Figure 8:
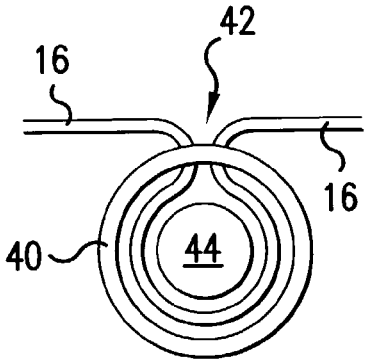
FIG. 8 is an end view of the anchor shown in FIG. 7.
Figure 17:
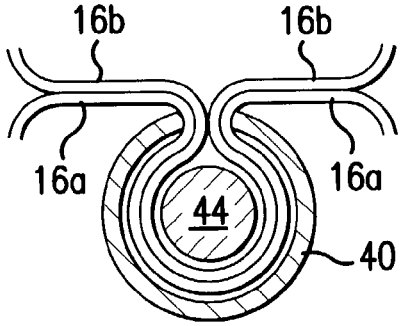
FIG. 17 is a diagram showing an arrangement where the two thicknesses of the strap extending in different directions are held by a single anchor.

As noted above, it is sometimes necessary to provide additional locking for the strap either on one of the holders or in other situations. FIGS. 6 through 8 show the use of an anchor which may be used in conjunction with the rack described in FIGS. 1 through 5 or in other situations. The anchor consists of a tube 40 which has an opening 42 cut in the face thereof. The tube 40 may be a piece of metal pipe or conduit and the opening 42 may be cut using a torch or other cutting implement. In operation, a rod 44 may be placed within the tube 40 and a strap 16 inserted in the opening, around the rod and back out the opening. This is best seen in FIG. 8. Given the proper dimensions, the strap 16 will be tightly held in place between the tube 40 and the rod 44, adding enough friction to prevent the movement of the strap even under heavy loads. For example, tube 40 may have an internal diameter of ¾ of an inch and the rod may have an external diameter of ½ inch. If the strap 16 is ⅛ inch thick, there is just sufficient clearance between the rod and tube to receive the strap 16. There is constant contact between the sides of the strap 16 and either the inside of the tube or the outside of the rod. This frictional arrangement holds the strap 16 firmly in position. It is also possible to have two or more thicknesses of the strap 16 extending into the tube, if there is sufficient clearance between the rod and the tube. This is especially suitable where the two thicknesses 16*a*, 16*b* of the strap eventually extend in different directions as shown in FIG. 17. This allows two thicknesses 16*a*, 16*b* of the strap 16 to be held by a single anchor. Where the two straps 16 are desirable for additional weight capacity, the size of the tube or rod can be adjusted so that additional strap thicknesses can be accommodated.

At point C, it would be possible to use a similar tube and rod arrangement if desired. However, the preferred method is to use a tube and rod attached to a metal channel. This provides the plate with more strength when lifting and also provides extra safety to prevent the rod from slipping beyond the channel legs. While these fastening arrangements are preferred, because of their simplicity of installing, it would also be possible to sew the straps together at the various locations. Since the straps extend all the way around each of the tanks, they provide extra padding to prevent damage when the system is lifted. The arrangement of tanks may be lifted from the plates at point A and B as indicated above.

As noted above, it is sometimes necessary to provide additional locking for the strap either on one of the holders or in other situations. FIGS. 6 through 8 and 17 show the use of an anchor which may be used in conjunction with the rack described in FIGS. 1 through 5 or in other situations. The anchor consists of a tube 40 which has an opening 42 cut in the face thereof. The tube 40 may be a piece of metal pipe or conduit and the opening 42 may be cut using a torch or other cutting implement. In operation, a rod 44 may be placed within the tube 40 and a strap 16 inserted in the opening, around the rod and back out the opening. This is best seen in FIG. 8. Given the proper dimensions, the strap will be tightly held in place between the tube 40 and the rod 44, adding enough friction to prevent the movement of the strap even under heavy loads. For example, tube 40 may have an internal diameter of ¾ of an inch and the rod may have an external diameter of ½ inch. If the strap is ⅛ inch thick, there is just sufficient clearance between the rod and tube to receive the strap. There is constant contact between the sides of the strap and either the inside of the tube or the outside of the rod. This frictional arrangement holds the strap firmly in position.

It is also possible to have two or more thicknesses of the strap extending into the tube as shown in FIG. 17, if there is sufficient clearance between the rod and the tube. FIG. 17 shows a similar arrangement to FIG. 8 but with the end cut away to show the opening through which the straps are received. In this arrangement, two separate straps 16A and 16B are anchored together. The tube may also be attached to a plate or channel member as described above. This is especially suitable where the two thicknesses eventually extend in different directions, such as straps 16A and 16B. This allows the straps to be held by a single anchor. Two straps may be desirable for additional weight capacity in some cases. The size of the tube or rod can be adjusted so that additional strap thicknesses can be accommodated if desired.

While rod 44 has been described merely as a solid cylindrical object, it may instead be replaced by a nut and bolt arrangement. Thus, it would be possible for both the head of the bolt and the nut (used with a washer if necessary) to be tightened on opposite ends of the tube. This would prevent any movement of the central rod. It would also be possible for either the head of the bolt or the nut, or both, to have a diameter smaller than the inside diameter of the tube so that as the bolt is tightened, compression is applied to the strap in the direction of the length of the bolt. This causes the strap to be narrowed, with the excess material filling any openings between the rod and tube, thus increasing the frictional engagement of the strap with the anchor. It is also possible that if the screw threads of the bolt are in contact with the strap, then they will become embedded in the strap to further hold the strap in position.

Another particularly desirable possibility is use of a lag bolt rather than a bolt and nut arrangement. When the lag bolt is screwed into position, the screwed threads imbed themselves in a strap. Because the threads come to a point rather than a blunt end as in a standard bolt, the lag bolt threads into the strap more easily. In addition, once the bolt is screwed into position, it is possible to tap the end of the bolt with a hammer so that the hexagonal head is forced into the circular opening in the tube. This prevents the head of the lag bolt from turning so that the strap is held more firmly. It has been discovered that the heads of lag bolts are just slightly larger than the inner diameter of the corresponding tubes and that this arrangement works particularly well.

Other possibilities also exist, such as providing a tubular insert between the head of the bolt and the top of the strap or between the nut and the bottom of the strap. These inserts would have an internal diameter just larger than the central rod 44 and an external diameter smaller than the internal diameter of the tube 40. This will allow the nut and bolt to be tightened to apply pressure to the strap while allowing the nut or bolt to be more easily accessible outside the end of the tube.

While the preferred material for the anchor and rod is metal, other materials can also be used such as wood or plastic materials, as long as the strength requirements are provided.

This anchor may be used in any situation where a flexible strap needs to be held tightly. An anchor can be provided along the periphery of the holder so that after placing the strap through the H-shaped cutouts, the end may then be firmly held in place. The anchor can be welded or otherwise attached to the holder. The anchor can be attached on side 26 which is not in contact with any of the articles in the rack. Alternatively, the anchor could be recessed at any surface of the holder.

Figure 9:
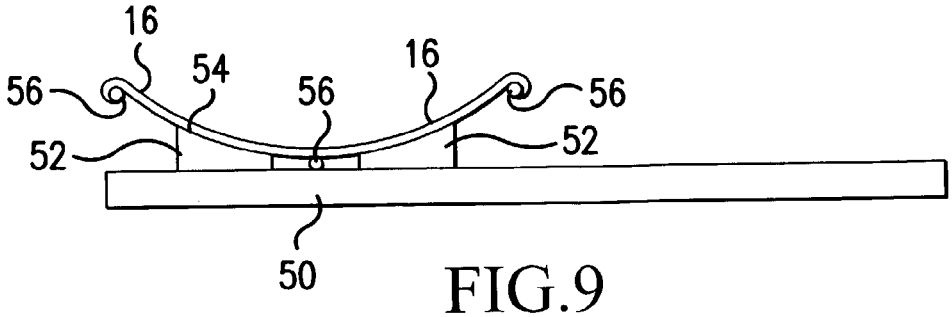
FIG. 9 is a side view of a locator rack including three anchors according to the present invention.

Another use for the anchor is on a locator rack which is placed on the floor of the truck before assembling the articles thereon. Such a device is shown as element 42 in FIG. 3 of U.S. Pat. No. 5,735,412. However, in this prior art arrangement, arcuate indentations 44 are formed in a solid support 42 in order to receive the circular articles 46. In order to avoid the need to have padding, the present invention uses an anchor on the locator rack. As shown in FIG. 9, a bar or other support 50 extends across the floor of the truck. Trapezoidal shaped elements 52 are attached to support 50 and act to hold curved piece 54 in position. These three parts may be welded together or otherwise attached. Curved piece 54 matches the curve of the wall of the article to be stored.

Anchors 56 are provided on the bottom side at each end of wall 54 and on the bottom side in the center of wall 54 also. Either wall 54 may be discontinuous at this point to receive the center anchor, or an opening may be cut in the wall above the opening in the tube of central anchor 56. Strap 16 has one end fixed in one of the end anchors and then extends over the face of wall 54 to form a pad for the article to be placed thereon. It is anchored in the center by the center anchor and then extends up the other side of wall 54 to the other end anchor. Of course, the strap may be of double thickness for thicker cushioning.

Other arrangements of the locator rack are also possible. Thus the locator rack does not necessarily have to have wall 54 and could instead have anchor 56 directly mounted on an upstanding brace so that the strap itself forms the holder for the article.

Another arrangement for the locator rack is to use a rack which has a larger size than that of the tank. On a point about halfway or higher on each side of wall 54, a roller is provided which is mounted on an axle so that the top of the roller extends above the surface of the wall. The strap extends around the bottom of the roller so that the tank can come into contact with the roller. It is often desirable to rotate the tanks in order to save space. This can be accomplished by tipping the tank over to one side so that it contacts the roller and may then be rotated to the position desired before being returned to the center position of the locator rack. This is a major improvement over past procedures which usually are accomplished by prying against the tank surface with a two-by-four or similar stiff lever. This system allows the tank to be repositioned without damage to the paint. However, once the tank has been returned to the center portion, it is held and in place safely and rigidly.

The strap which has been discussed can be of any material such as cloth, nylon, polyester and any other flexible material. The only requirement is that it be flexible enough to assume the shape of the article which is placed on it and that it be strong enough to withstand the weight of the article. Such materials are well known and are used for strapping and carrying heavy loads to be lifted by cranes, for holding heavy loads in place on trucks, ships, trains or the like and in other environments where strong and flexible materials are necessary.

The present rack has been described in terms of holding articles such as propane tanks on a truck. However, this device may be used in other situations such as on other kinds of vehicles or in warehouses. It can also be used in other articles which are round in configuration or for articles having other shapes.

As discussed above, this particular arrangement allows the rack to be built at a lower cost and is lighter in weight for easier handling.

Numerous additional modifications and variations of the present invention are possible in light of the above teachings. It is therefore to be understood that within the scope of the appended claims, the invention may be practiced otherwise than as specifically described herein.

What is claimed:

1. A rack for holding multiple articles, comprising:

at least two holders, the first holder including a first surface on one side thereof for receiving a first one of the multiple articles carried by said rack, and a second surface on an opposite side thereof for receiving a second one of the multiple articles carried by said rack, and the second holder including a first surface on one side thereof for receiving the second one of the multiple articles, and a second surface on an opposite side thereof for receiving a third one of the multiple articles carried by said rack; and a flexible strap joining said at least two holders;

said flexible strap extending around at least part of a periphery of each of said holders, forming a pad between each of the opposite side surfaces of said holders and the articles received therein;

wherein each of the opposite side surfaces of said holders has at least one cutout formed along said periphery for receiving said flexible strap below said surface therein to form a friction fit with said flexible strap.

2. The rack according to claim 1, wherein the cutouts are H-shaped cutouts.

3. The rack according to claim 1, wherein each of the opposite side surfaces in which the cutouts are formed is concave shaped.

4. The rack according to claim 1, wherein the cutouts are O-shaped cutouts.

5. The rack according to claim 1, wherein said flexible strap is adjustable by placing shims between said strap and said periphery to firmly secure said strap.

6. The rack according to claim 1, wherein said surfaces are made of channel material.

7. The rack according to claim 1, further comprising at least one sleeve through which said strap extends.

8. A holder for a rack, comprising:

the holder including a first surface on one side thereof for receiving a first article carried by said rack, and a second surface on an opposite side thereof for receiving a second article carried by said rack;

cutouts provided along said opposite side surfaces; and a flexible strap extending along said opposite side surfaces, forming pads between the opposites side surfaces of said holder and said first and second articles;

said strap extending through said cutouts and below said opposite side surfaces for forming friction fits therewith to hold said flexible strap in position.

9. The holder according to claim 8, wherein the cutouts are H-shaped cutouts.

10. The holder according to claim 8, wherein each of the opposite side surfaces in which the cutouts are formed is concave shaped.

11. The holder according to claim 8, wherein the cutouts are O-shaped cutouts.

12. The holder according to claim 8, wherein said strap is adjustable in length.

13. The holder according to claim 8, wherein said surfaces are made of channel material.

14. An anchor for holding a flexible strap, comprising:

a hollow tube having an opening in a wall extending in the axial direction of the tube; and a rod extending through said tube and being coaxial therewith; and an outer diameter of said rod being less than an inner diameter of said tube by an amount approximately equal to twice the thickness of a flexible strap;

wherein said flexible strap is received in said opening and extends around said rod to form a friction fit between an exterior surface of said rod and an interior surface of said tube.

15. The anchor according to claim 14, wherein said rod is a bolt.

16. The anchor according to claim 15, wherein said bolt receives a nut at one end.

17. The anchor according to claim 16, wherein said nut and bolt may be tightened in order to compress said strap to hold it more firmly.

18. The anchor according to claim 14, wherein said rod is a lag bolt.

19. The anchor according to claim 18, wherein a head of said lag bolt is slightly larger than said inner diameter of said tube so that said head may be forced into said tube to prevent the lag bolt from turning.

20. A holder for a rack, comprising:

the holder including a first surface on one side thereof for receiving a first article carried by said rack, and a second surface on an opposite side thereof for receiving a second article for receiving a second article held by said rack;

at least said opposite side surfaces having cutouts formed therein;

a flexible strap extending along said opposite side surfaces and being received in said cutouts to extend below said opposite side surfaces for forming friction fits with said strap; and an anchor for receiving an end of said strap and holding it firmly by way of a friction fit said anchor including a hollow tube having an opening in a wall and a rod extending coaxially through the tube.

21. The holder according to claim 20, wherein an outer diameter of said rod is less than an inner diameter of said tube by an amount approximately equal to twice the thickness of said flexible strap.

22. A system for holding a plurality of articles, comprising:

a holder including a first surface on one side thereof for receiving a first article carried by said rack, and a second surface on an opposite side thereof for receiving a second article carried by said rack;

cutouts provided along said opposite side surfaces; and at least one flexible strap extending along said opposite side surfaces, forming pads between the opposites side surfaces of said holder and said first and second articles;

said strap extending through said cutouts and below said opposite side surfaces for forming friction fits therewith to hold said flexible strap in position;

said strap extending completely around at least two of said articles;

said strap intercepting itself at at least one point, with ends of said strap being secured;

wherein said strap causes said first and second articles to be held tight when lifted and when other articles are placed thereon.

23. The anchor according to claim 14, wherein said flexible strap is received in said opening so that a first portion of the strap extends around said rod in one direction, and wherein said flexible strap is received in said opening and extends around said rod in a direction opposite to the one direction so that a second portion of the strap forms extends between the first portion and an interior surface of said tube, wherein the first and second portions of the strap form a friction fit between said exterior surface of rod and said interior surface of said tube.

* * * * *

UNITED STATES PATENT AND TRADEMARK OFFICE

CERTIFICATE OF CORRECTION

PATENT NO. : 7,591,384 B2
APPLICATION NO. : 10/336014
DATED : September 22, 2009
INVENTOR(S) : Amuel E. Sheckells It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1691 days.

Signed and Sealed this

Twenty-first Day of September, 2010

David J. Kappos

David J. Kappos
*Director of the United States Patent and Trademark Office*